US009631466B2

(12) United States Patent
Greci et al.

(10) Patent No.: US 9,631,466 B2
(45) Date of Patent: Apr. 25, 2017

(54) SIMULTANEOUS INJECTION AND PRODUCTION WELL SYSTEM

(71) Applicant: Halliburton Energy Services, Inc., Houston, TX (US)

(72) Inventors: Stephen Michael Greci, Little Elm, TX (US); Jean-Marc Lopez, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/911,520

(22) PCT Filed: Feb. 10, 2014

(86) PCT No.: PCT/US2014/015603
§ 371 (c)(1),
(2) Date: Feb. 11, 2016

(87) PCT Pub. No.: WO2015/119634
PCT Pub. Date: Aug. 13, 2015

(65) Prior Publication Data

US 2016/0186544 A1 Jun. 30, 2016

(51) Int. Cl.
*E21B 33/122* (2006.01)
*E21B 43/16* (2006.01)
(Continued)

(52) U.S. Cl.
CPC ..... *E21B 43/162* (2013.01); *E21B 33/12* (2013.01); *E21B 43/00* (2013.01); *E21B 43/14* (2013.01); *E21B 43/16* (2013.01); *E21B 43/166* (2013.01)

(58) Field of Classification Search
CPC ..... E21B 33/122; E21B 33/1277; E21B 33/1246; E21B 43/14
(Continued)

(56) References Cited

U.S. PATENT DOCUMENTS 6,481,503 B2 11/2002 Hamilton et al.
2006/0175061 A1 8/2006 Crichlow
(Continued)

FOREIGN PATENT DOCUMENTS

WO 2006069372 A2 6/2006
WO 2015119634 A2 8/2015

OTHER PUBLICATIONS

International Search Report and Written Opinion for PCT/US2014/015603 dated Oct. 22, 2015.

*Primary Examiner* — Doug Hutton, Jr.
*Assistant Examiner* — Ashish Varma
(74) *Attorney, Agent, or Firm* — McDermott Will & Emery LLP

(57) ABSTRACT

Systems for simultaneously injecting and producing in a well having multiple zones. One system includes a wellbore providing first perforations extending into a first subterranean formation and second perforations extending into a second subterranean formation, a production tubing having influx ports defined therein and an annulus defined between the wellbore and the production tubing, first and second pairs of wellbore isolation devices arranged about the production tubing and axially straddling the first and second perforations to define first and second formation zones, respectively, a first bypass conduit extending between the first pair of wellbore isolation devices, a second bypass conduit extending between the second pair of wellbore isolation devices, and an injection outlet defined on the first bypass conduit for injecting a portion of the fluid into the first subterranean formation and push hydrocarbons toward the second formation zone to be produced.

19 Claims, 2 Drawing Sheets

(51) Int. Cl.
*E21B 43/00* (2006.01)
*E21B 43/14* (2006.01)
*E21B 33/12* (2006.01)

(58) Field of Classification Search
USPC ..... 166/305.1
See application file for complete search history.

(56) References Cited

U.S. PATENT DOCUMENTS

| | | | | |
|---|---|---|---|---|
| 2011/0132593 | A1* | 6/2011 | Phloi-montri | E21B 43/122<br>166/54.1 |
| 2013/0160996 | A1 | 6/2013 | Maier et al. | |
| 2013/0248179 | A1* | 9/2013 | Yeh | E21B 23/06<br>166/278 |

* cited by examiner

SIMULTANEOUS INJECTION AND PRODUCTION WELL SYSTEM

BACKGROUND

The present disclosure relates to equipment used in the production of hydrocarbons and, more particularly, to systems for simultaneously injecting and producing in a well having multiple zones of interest.

In the oil and gas industry, wellbores are often drilled through multiple subterranean formations, thereby resulting in the establishment of several production zones at various locations along the well. In order to obtain maximum productivity from a single well, fluids are often injected into the surrounding subterranean formations at strategic locations and used to push or otherwise impel hydrocarbons toward a particular production zone for production to the surface.

Known downhole equipment and tools are generally limited to the production of fluid or the injection of fluid at any given time, with simultaneous production and injection not being possible, or at least difficult. More particularly, fluid injection operations are usually carried out first in the wellbore and the injection equipment is subsequently returned to the surface so that appropriate production equipment can then be extended downhole and used to produce fluids to the surface.

In order to increase efficiency, it may be desirable to produce formation fluids from one or more zones, while simultaneously injecting fluids into one or more other zones.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to equipment used in the production of hydrocarbons and, more particularly, to systems for simultaneously injecting and producing in a well having multiple zones of interest.

The systems and methods disclosed herein allow fluid injection into selected subterranean formation zones, while simultaneously facilitating hydrocarbon production in adjacent formation zones within the same well. As described herein, this can be accomplished using one or more bypass conduits that extend through wellbore isolation packers used to define the various formation zones. The bypass conduits allow a fluid introduced into the annulus between the wellbore and production tubing extended into the wellbore to "bypass" or otherwise traverse selected formation zones. One or more of the bypass conduits may further facilitate injection of the fluid into predetermined formation zones.

The injected fluid may impel hydrocarbons toward producing formation zones to subsequently be drawn into the production tubing and produced to a surface location. In some embodiments, the bypass conduits may be generally tubular structures extending longitudinally between corresponding pairs of packers in the wellbore. In other embodiments, the bypass conduits may be annular conduits that extend about the outer surface of the production tubing and thereby form a concentric arrangement therewith.

Figure 1:
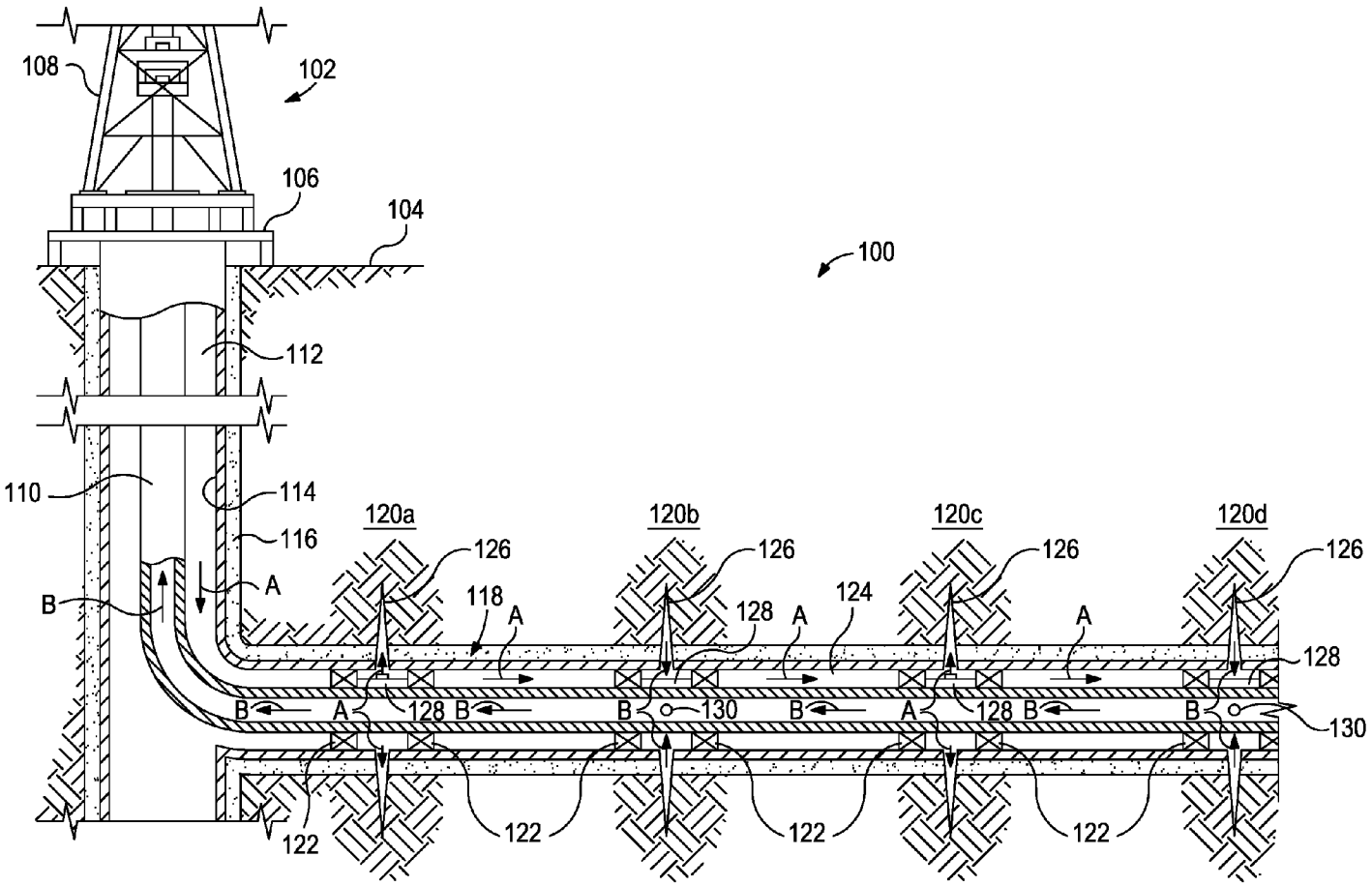
FIG. 1 illustrates an exemplary well system that can employ one or more principles of the present disclosure, according to one or more embodiments.

Referring to FIG. 1, illustrated is an exemplary well system 100 that can employ one or more principles of the present disclosure, according to one or more embodiments. As illustrated, the well system 100 may include an oil and gas rig 102 arranged at the Earth's surface 104. The rig 102 may include a rig floor 106 and a derrick 108 arranged on the rig floor 106. The derrick 108 may support or otherwise help manipulate the position of production tubing 110 configured to be extended into a wellbore 112 that is drilled into the Earth's surface 104 below the rig floor 106. Even though FIG. 1 depicts a land-based oil and gas rig 102, it should be noted that the embodiments described herein are equally well suited for use in other types of rigs, such as offshore platforms, or rigs used in any other geographical location.

The wellbore 112 may be completed with a casing string 114 secured into position using, for example, cement 116. As illustrated, the wellbore 112 extends vertically away from the surface 104 over a vertical wellbore portion. In other embodiments, the wellbore 112 may deviate from vertical at any angle from the surface 104. The wellbore 112 may also include a lateral portion 118 that extends from the vertical portion and the production tubing 110 may be configured to extend into the lateral portion 118. As illustrated, the lateral portion 118 may also be completed with casing 114 and cement 116. In other applications, portions or substantially all of the wellbore 112 may be vertical, deviated, horizontal, and/or curved.

It is noted that although FIG. 1 depicts both horizontal and vertical portions of the wellbore 112, and the production tubing 110 being extended into the lateral portion 118 for operation, the embodiments described herein are equally applicable to or otherwise suitable for use in wholly vertical wellbore configurations. Consequently, the horizontal or vertical nature of the wellbore 112 should not be construed as limiting the present disclosure to any particular wellbore 112 configuration.

As depicted, the lateral portion 118 of the wellbore 112 may extend through one or more subterranean formations 120 (shown as formations 120*a*, 120*b*, 120*c*, and 120*d*). Each formation 120*a-d* may belong to the same general subterranean formation or may alternatively form part of individual subterranean formations. Hydrocarbons, such as oil and gas, may be present within some or all of the formations 120*a-d*. In order to access and produce such hydrocarbons to the surface 104, the production tubing 110 is extended into the lateral portion 118 of the wellbore 112. The production tubing 110 may be secured within the lateral portion 118 using one or more packers 122, or other wellbore isolation devices known to those skilled in the art. The packers 122 may be configured to seal off portions of an annulus 124 defined between the production tubing 110 and the walls of the wellbore 112 and/or the casing 114.

As illustrated, the lateral portion 118 of the wellbore 112 has been perforated in various locations, thereby resulting in perforations 126 that extend through the casing 114 and cement 116, and further into the surrounding formations 120*a-d*. Via the perforations 126, the formations 120*a-d* may be hydraulically fractured and/or treated, if desired, in order to enhance subsequent hydrocarbon production. The perforations 126 provide fluid communication between the formations 120*a-d* and the wellbore 112 and annulus 124. Upon arranging the production tubing 110 in the wellbore 112, the packers 122 may be set so as to axially span or straddle the perforations 126. As a result, the wellbore 112 may be effectively divided into multiple formation intervals or zones of interest which may be stimulated and/or produced independently via isolated portions of the annulus 124 defined between adjacent pairs of packers 122. While only four zones of interest are shown in FIG. 1, those skilled in the art will readily recognize that any number of zones may be defined and otherwise used in the well system 100, without departing from the scope of the disclosure.

The well system 100 may further include one or more bypass conduits 128 that extend axially along the exterior of the production tubing 110 and between adjacent packers 122 over corresponding formation intervals. As described in greater detail below, the bypass conduits 128 may be configured to straddle the perforations 126 in each formation interval and allow a fluid introduced into the annulus 124 to bypass the packers 122 and selectively bypass various hydrocarbon-producing formations 120*a-d*. Some bypass conduits 128 may facilitate injection of the fluid into one or more of the adjacent formations 120*a-d*, while others provide an isolated pathway for the fluid to traverse formation intervals where hydrocarbons, such as gases and/or oil, are drawn into the production tubing 110 from adjacent formations 120*a-d*.

In the illustrated embodiment, for example, a fluid (e.g., a gas or water) may be injected into the first and third formations 120*a* and 120*c*, as indicated by the arrows A. The fluid A may originate either at the surface 104 or at a point between the surface 104 and the first formation 120*a*. The fluid A may be conveyed to the first and third formations 120*a,c* via the annulus 124 defined between the production tubing 110 and the casing 114. The fluid A injected into the first and third formations 120*a,c* may serve to push hydrocarbons toward the second and fourth formations 120*b* and 120*d*. The hydrocarbons may then be drawn into the production tubing 110 via one or more influx ports 130 defined therein, as indicated by the arrows B. Once in the production tubing 110 the hydrocarbons B may be produced to the surface 104.

The bypass conduits 128 that extend between the packers 122 at the second and fourth formations 120*b,d* may be configured to allow the fluid A to traverse the corresponding formation interval and thereby proceed further downhole to potentially interact with other formation intervals. Accordingly, the well system 100 may prove advantageous in allowing fluid injection in selected formation zones, while simultaneously allowing hydrocarbon production in adjacent formation zones in the same wellbore 112.

Figure 2:
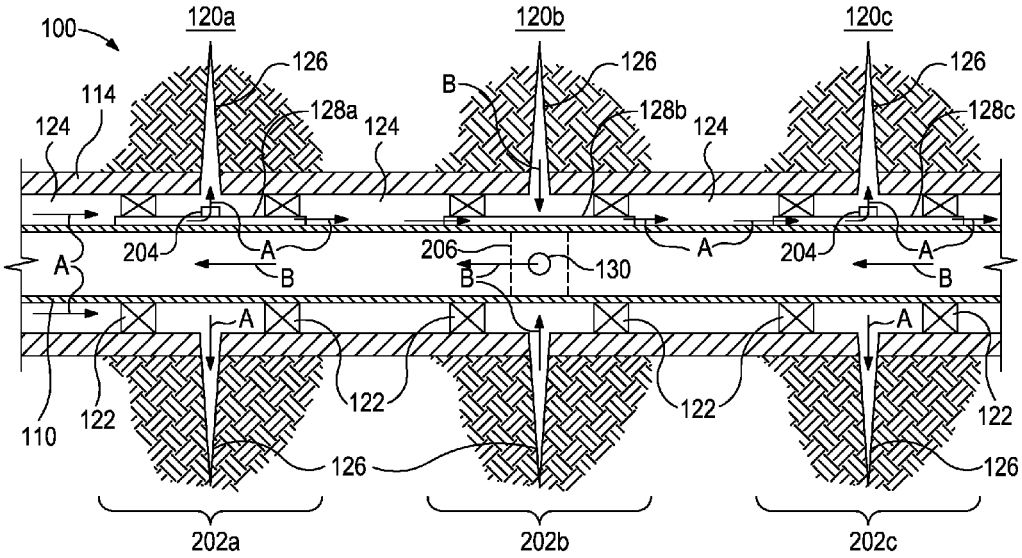
FIG. 2 illustrates an enlarged view of a portion of one embodiment of the well system of FIG. 1, according to one or more embodiments.

Referring now to FIG. 2, with continued reference to FIG. 1, illustrated is an enlarged view of a portion of one embodiment of the well system 100, according to one or more embodiments. Like numerals used in FIG. 1 that are used in FIG. 2 refer to like components or elements of the well system 100 that will not be described again. The first, second, and third formations 120*a-c* are depicted in FIG. 2 and correspond to first, second, and third formation zones 202*a*, 202*b*, and 202*c*, respectively. As will be appreciated by those skilled in the art, more than three formations 120*a-c* and corresponding formation zones 202*a-c* may be included in the well system 100, without departing from the scope of the disclosure.

Each formation zone 202*a-c* may include one or more perforations 126 defined through the casing 114 and any surrounding cement 116 (not shown) so as to facilitate fluid communication between the corresponding formations 120*a-c* and the annulus 124 defined between the wellbore 112 (FIG. 1) and the production tubing 110. Moreover, each formation zone 202*a-c* may be generally defined between an adjacent pair of packers 122 set on opposing sides of the perforations 126, and thereby creating isolated portions of the annulus 124 corresponding to each formation zone 202*a-c*. More particularly, the packers 122 may be deployed within the annulus 124 and form a fluid tight seal against the inner wall of the casing 114 such that fluids are generally prevented from migrating axially along the production tubing 110 and past the packers 122.

The packers 122 may be swell packers configured to expand or "swell" upon contact with the downhole environment. In some embodiments, for example, the packers 122 may be made of materials (e.g., elastomers, polymers, etc.) configured to expand and seal against the production tubing 110 and the casing 114 upon being exposed to water or oil present within the annulus 124. In other embodiments, the packers 122 may be made of materials configured to expand upon being exposed to a predetermined temperature or pressure within the annulus. Those skilled in the art will readily appreciate that various types of swell packers made of various types of materials, and means of deploying said packers, may be used in accordance with the present disclosure.

Each formation zone 202*a-c* may further include one or more bypass conduits 128 (shown as first, second, and third bypass conduits 128*a*, 128*b*, and 128*c*) that extend axially along the exterior of the production tubing 110 and between adjacent packers 122. As depicted in FIG. 2, the bypass conduits 128*a-c* may be generally tubular members. As discussed below, however, the bypass conduits 128*a-c* may also take on other shapes and/or configurations, without departing from the scope of the disclosure. Moreover, while only a single bypass conduit 128*a-c* is depicted as being used in each formation zone 202*a-c*, it will be appreciated that more than one bypass conduit 128*a-c* may be employed. For instance, two or more tubular bypass conduits 128*a-c* may be strategically arranged about the circumference of the production tubing 110, without departing from the scope of the disclosure.

Each bypass conduit 128*a-c* extends through the packers 122 of its corresponding formation zone 202*a-c*. In some embodiments, the bypass conduits 128*a-c* may radially interpose the packers 122 and the exterior of the production tubing 110, and thereby coming into contact with each. In other embodiments, however, the bypass conduits 128*a-c* may extend axially through the packers 122 and otherwise not in contact with the production tubing 110. As each packer 122 is set within the annulus 124, the bypass conduits 128*a-c* become firmly secured for downhole operation. The bypass conduits 128*a-c* may allow fluids present within the annulus 124 to flow across the formation zones 202*a-c*.

At least some of the bypass conduits 128*a-c* include or otherwise define one or more injection outlets 204. For example, in the illustrated embodiment, the first and third bypass conduits 128*a,c* include corresponding injection outlets 204. The injection outlets 204 facilitate fluid communication between the first and third bypass conduits 128*a,c* and the corresponding surrounding first and third formations 120*a,c*. Accordingly, fluids introduced into the annulus 124 may be able to access the first and third formations 120*a,c* via the injection outlets 204 of the first and third bypass conduits 128*a,c*. In some embodiments, the injection outlets 204 may be or otherwise include a nozzle or other type of flow-restricting device. As a result, the injection outlets 204 may be configured to meter or regulate the flow of fluids into the first and third formations 120*a,c*. This may prove advantageous in allowing an operator to regulate the amount of fluid injection into the corresponding formation zones 202*a,c* and otherwise make the fluid injection uniform, if desired.

Exemplary operation of the well system 100 of FIG. 2 is now provided. As indicated by the arrows A, a fluid A may be introduced into the annulus 124 defined between the production tubing 110 and the inner wall of the casing 114. The fluid A may be any fluid used in wellbore injection operations. In some embodiments, for example, the fluid A may be a gas such as, but not limited to, carbon dioxide, air, methane, nitrogen, and natural gas. In other embodiments, the fluid A may be a liquid such as, but not limited to, fresh water, brine, seawater, and gels.

In some embodiments, the fluid A may be introduced into the annulus 124 of the wellbore 112 at the surface 104 (FIG. 1). In other embodiments, the fluid A may be introduced into the annulus 124 at a point within the wellbore 112 below the surface 104, such as through the use of coiled tubing or the like that may be extended into the wellbore 112 to an intermediate location.

Once the fluid A reaches the first formation zone 202*a*, a portion of the fluid A is able to bypass or otherwise traverse the packers 122 of the first formation zone 202*a* via the first bypass conduit 128*a* and flow further downhole toward the second formation zone 202*b* within the annulus 124. The second bypass conduit 128*b* may receive the fluid A and convey the fluid A across the second formation zone 202*b*. Once exiting the second bypass conduit 128*b*, the fluid A may flow toward the third formation zone 202*c* within the annulus 124 where it may be received by the third bypass conduit 128*c*. The third bypass conduit 128*c* may also allow the fluid A to traverse the third formation zone 202*c* and flow further downhole within the annulus 124. In at least one embodiment, however, the third bypass conduit 128*c* may be sealed at its downhole end and otherwise prevent the fluid A from progressing further downhole within the wellbore 112 past the third formation zone 202*c*.

At the first and third formation zones 202*a,c*, a portion of the fluid A may be injected into the first and third formations 120*a,c*. More particularly, as the fluid A flows through the first and third bypass conduits 128*a,c*, a portion of the fluid A may be injected into the first and third formations 120*a,c* via the injection outlets 204 provided on the first and third bypass conduit 128*a,c*. The fluid A injected into the first and third formations 120*a,c* may be configured to push or otherwise impel fluids, such as hydrocarbons, toward the second formation 120*b* and the second formation zone 202*b*. The hydrocarbons may then be drawn into the production tubing 110 via the one or more influx ports 130 defined in the production tubing 110, as indicated by the arrows B. Once in the production tubing 110, the hydrocarbons B may be produced to the surface 104.

In some embodiments, one or more of the influx ports 130 may include a sleeve 206 (shown in dashed) that may be moved in order to selectively open or close the corresponding influx port 130. In at least one embodiment, the sleeve 206 may be annular and therefore able to selectively open or close each influx port 130 simultaneously. The sleeve 206 may be mounted on either the exterior or the interior of the production tubing 110. The sleeve 206 may be characterized as a sliding side door that is able to axially translate with respect to the influx port(s) 130, and thereby either occlude or expose the influx port(s) 130. The sleeve 206 may be moved using any type of actuation device or mechanism known to those skilled in the art including, but not limited to, mechanical, electrical, electro-mechanical, hydraulic, and pneumatic actuators.

In at least one embodiment, an operator from the surface 104 (FIG. 1) may be able to selectively actuate the sleeve 206 between open and closed positions. As will be appreciated, the sleeve 206 may prove useful in the event there is a water or gas breakthrough in a producing formation zone (e.g., the second formation zone 202*b*). In such an event, the operator (or an automated computer system) may detect the breakthrough and cause the sleeve 206 to be actuated to the closed position, thereby preventing the production of unwanted fluids into the production tubing 110 and to the surface 104.

Advantageously, since the second bypass conduit 128*b* provides a sealed conduit or channel that extends across the second formation zone 202*b*, the fluids A coursing through the second bypass conduit 128*b* are not intermingled or otherwise mixed with the hydrocarbons B being drawn into the production tubing 110. Instead, the incoming hydrocarbons B flow around the second bypass conduit 128*b* until locating the influx port(s) 130. Accordingly, the well system 100 may prove advantageous in allowing the injection of fluids A in selected formation zones 202*a,c*, while simultaneously allowing hydrocarbon B production in other formation zones 202*b* in the same wellbore 112.

Figure 3:
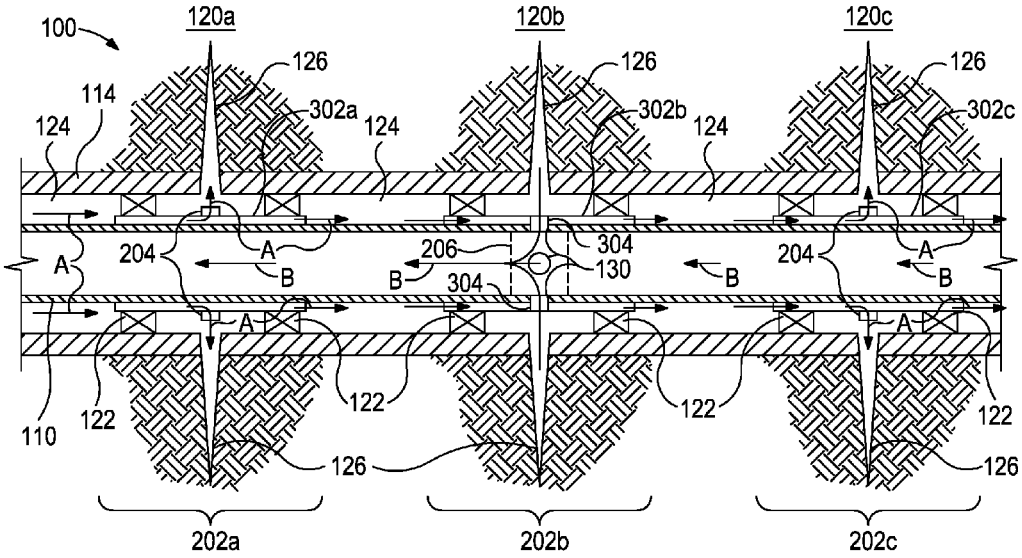
FIG. 3 illustrates an enlarged view of a portion of another embodiment of the well system of FIG. 1, according to one or more embodiments.

Referring now to FIG. 3, with continued reference to FIG. 2, illustrated is an enlarged view of a portion of another embodiment of the well system 100 of FIG. 1, according to one or more embodiments. Again, like numerals used in FIGS. 1 and 2 that are used in FIG. 3 refer to like components or elements of the well system 100 that will not be described again. The first, second, and third formations 120*a-c* are again depicted in FIG. 3 and correspond to the first, second, and third formation zones 202*a-c*, respectively.

Similar to the well system 100 of FIG. 2, the well system 100 depicted in FIG. 3 may include adjacent pairs of packers 122 set on opposing sides of the perforations 126 to create isolated portions of the annulus 124 corresponding to each formation zone 202*a-c*. Unlike the well system 100 of FIG. 2, however, the well system 100 depicted in FIG. 3 may include bypass conduits 302 (shown as first, second, and third bypass conduits 302*a*, 302*b*, and 302*c*) that are annular and extend about the outer circumference of the production tubing 110 such that a concentric (or eccentric) relationship between the two components results. Each annular bypass conduit 302*a-c* extends axially along the production tubing 110 and between adjacent packers 122. In some embodiments, the annular bypass conduits 302*a-c* may be secured to the outer surface of the production tubing 110 using one or more mechanical fasteners (not shown) or otherwise (e.g., adhesives, welding, brazing, pins, set screws, etc.).

Each annular bypass conduit 302*a-c* spans its corresponding formation zone 202*a-c*, and as each packer 122 is set within the annulus 124, the annular bypass conduits 302*a-c* are each secured for downhole operation. Similar to the bypass conduits 128*a-c* of FIG. 2, the annular bypass conduits 302*a-c* may allow fluids within the annulus 124 to flow across the corresponding formation zones 202*a-c*.

Moreover, at least some of the annular bypass conduits 302*a-c* may include one or more injection outlets 204. In the illustrated embodiment, for example, the first and third annular bypass conduits 302*a,c* each include one or more injection outlets 204 that facilitate fluid communication between the first and third bypass conduits 302*a,c* and the corresponding surrounding first and third formations 120*a,c*. As discussed above, in some embodiments, the injection outlet(s) 204 may be or otherwise include a nozzle or other type of flow-restricting device used to meter or regulate the fluid flow into adjacent formations (e.g., the first and third formations 120*a,c*).

Because of the annular nature of the annular bypass conduits 302*a-c*, at least one of the annular bypass conduits 302*a-c* may include one or more production ports 304 defined therethrough in order to facilitate the passage of hydrocarbons to the production tubing 110. In the illustrated embodiment, for example, the second annular bypass conduit 302*b* includes at least two production ports 304 spaced about its circumference. The production ports 304 may extend radially through the second annular bypass conduit 302*b* at predetermined locations and may be configured to axially and angularly align with corresponding influx ports 130 of the production tubing 110. As a result, the production ports 304 may facilitate fluid communication between the second formation 120*b* and the interior of the production tubing 110.

Each production port 304 may provide an isolated channel extending radially through the second annular bypass conduit 302*b* such that any fluids flowing axially through the second annular bypass conduit 302*b* are prevented from intermixing with any fluids flowing radially through the production ports 304. As will be appreciated, more or less than two production ports 304 may be used in the second annular bypass conduit 302*b*. In at least one embodiment, for example the number of production ports 304 defined in the second annular bypass conduit 302*b* may be equal to the number of influx ports 130 at that location along the production tubing 110.

Exemplary operation of the well system 100 of FIG. 3 is now provided. As indicated by the arrows A, a fluid A may be introduced into the annulus 124 defined between the production tubing 110 and the inner wall of the casing 114. The annular bypass conduits 302*a-c* allow a portion of the fluid A to bypass or otherwise traverse the packers 122 of the first, second, and third formation zones 202*a-c* within the annulus 124. At the first and third formation zones 202*a,c*, however, a portion of the fluid A may be injected into the first and third formations 120*a,c*. More particularly, as the fluid A flows through the first and third annular bypass conduits 302*a,c*, a portion of the fluid A may be injected into the first and third formations 120*a,c*, respectively, via the injection outlets 204.

The fluid A injected into the first and third formations 120*a,c* may push or otherwise impel fluids, such as hydrocarbons, toward the second formation 120*b* and the corresponding second formation zone 202*b*. As indicated by the arrows B, hydrocarbons B may be drawn into the production tubing 110 via the production port(s) 304 defined through the second annular bypass conduit 302*b* and the associated influx port(s) 130 defined in the production tubing 110. Once in the production tubing 110 the hydrocarbons B may be produced to the surface 104. In some embodiments, a sleeve 206 may be mounted on either the exterior or the interior of the production tubing 110 and moved axially in order to selectively open or close the corresponding influx port(s) 130. As indicated above, the sleeve 206 may be actuated using any type of actuation device or mechanism known to those skilled in the art including, but not limited to, mechanical, electrical, electro-mechanical, hydraulic, and pneumatic actuators. Moreover, the sleeve 206 may be operated by an operator at the surface 104 (FIG. 1) or may alternatively be operated by an automated computer system (not shown).

Embodiments disclosed herein include:

A. A well system that includes a wellbore providing one or more first perforations extending into a first subterranean formation and one or more second perforations extending into a second subterranean formation, a production tubing arranged within the wellbore and having one or more influx ports defined therein, an annulus being defined between the wellbore and the production tubing, a first pair of wellbore isolation devices arranged about the production tubing and axially straddling the one or more first perforations to define a first formation zone, a second pair of wellbore isolation devices arranged about the production tubing and axially straddling the one or more second perforations to define a second formation zone, at least one first bypass conduit extending between the first pair of wellbore isolation devices and being configured to allow a fluid within the annulus to axially traverse the first formation zone, at least one second bypass conduit extending between the second pair of wellbore isolation devices and being configured to receive the fluid from the at least one first bypass conduit and allow the fluid to axially traverse the second formation zone, and one or more injection outlets defined on the at least one first bypass conduit and configured to allow a portion of the fluid to be injected into the first subterranean formation to push hydrocarbons toward the second subterranean formation to be drawn into the production tubing at the second formation zone via the one or more influx ports.

B. A method that includes introducing a production tubing into a wellbore having one or more first perforations extending into a first subterranean formation and one or more second perforations extending into a second subterranean formation, the production tubing having one or more influx ports defined therein and an annulus being defined between the wellbore and the production tubing, securing the production tubing within the wellbore with first and second pairs of wellbore isolation devices arranged about the production tubing, the first pair of wellbore isolation devices axially straddling the one or more first perforations to define a first formation zone, and the second pair of wellbore isolation devices axially straddling the one or more second perforations to define a second formation zone, conveying a fluid within the annulus to the first formation zone, allowing the fluid to axially traverse the first formation zone via at least one first bypass conduit extending between the first pair of wellbore isolation devices, receiving the fluid from the at least one first bypass conduit with at least one second bypass conduit extending between the second pair of wellbore isolation devices, injecting a portion of the fluid into the first subterranean formation via one or more injection outlets defined on the at least one first bypass conduit, and drawing the hydrocarbons into the production tubing at the second formation zone via the one or more influx ports.

Each of embodiments A and B may have one or more of the following additional elements in any combination: Element 1: wherein the wellbore is at least partially lined with casing and cement and the one or more first and second perforations are defined through the casing and cement. Element 2: wherein the first and second pair of wellbore isolation devices are packers and the at least one first and second bypass conduits extend through the first and second pair of wellbore isolation devices, respectively. Element 3: wherein the first and second subterranean formations are part of the same subterranean formation. Element 4: wherein the fluid in the annulus is a gas, water, or a combination of gas and water. Element 5: wherein the fluid in the annulus originates either at a surface location or at an intermediate point within the wellbore between the surface location and the first formation zone. Element 6: wherein at least one of the first and second bypass conduits is a tubular member extending axially along an exterior of the production tubing. Element 7: wherein the at least one second bypass conduit is annular and extends about an outer circumference of the production tubing and interposes the production tubing and the second pair of wellbore isolation devices. Element 8: further comprising one or more production ports defined radially through the at least one second bypass conduit. Element 9: wherein at least one of the one or more production ports axially and angularly aligns with a corresponding at least one of the one or more influx ports. Element 10: wherein at least one of the one or more injection outlets is a nozzle configured to restrict a flow of the fluid into the first subterranean formation. Element 11: further comprising a sleeve arranged on the production tubing and movable between an open position, where the one or more influx ports are exposed, and a closed position, where the one or more influx ports are occluded.

Element 12: further comprising allowing the fluid to axially traverse the second formation zone via the at least one second bypass conduit. Element 13: wherein the first and second pairs of wellbore isolation devices are swell packers and securing the production tubing within the wellbore comprises expanding the first and second pairs of wellbore isolation devices, and sealing portions of the annulus with the first and second pairs of wellbore isolation devices. Element 14: wherein conveying the fluid within the annulus to the first formation zone comprises introducing the fluid into the annulus at a surface location. Element 15: wherein conveying the fluid within the annulus to the first formation zone comprises introducing the fluid into the annulus at an intermediate point within the wellbore between a surface location and the first formation zone. Element 16: wherein at least one of the one or more injection outlets is a nozzle, the method further comprising restricting a flow of the portion of the fluid into the first subterranean formation with the nozzle. Element 17: wherein injecting the portion of the fluid into the first subterranean formation comprises pushing hydrocarbons toward the second subterranean formation with the portion of the fluid. Element 18: further comprising axially moving a sleeve arranged on the production tubing to regulate a flow of the hydrocarbons through the one or more influx ports, the sleeve being movable between an open position, where the one or more influx ports are exposed, and a closed position, where the one or more influx ports are occluded. Element 19: wherein the at least one second bypass conduit is annular and extends about an outer circumference of the production tubing, and wherein drawing the hydrocarbons into the production tubing at the second formation zone further comprises conveying the hydrocarbons through one or more production ports defined radially through the at least one second bypass conduit.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A well system, comprising:

a wellbore penetrating a first subterranean formation and a second subterranean formation;

a production tubing arranged within the wellbore and thereby defining an annulus between the wellbore and the production tubing;

a first pair of wellbore isolation devices arranged about the production tubing adjacent the first subterranean formation to define a first formation zone within the annulus;

a second pair of wellbore isolation devices arranged about the production tubing adjacent the second subterranean formation to define a second formation zone within the annulus;

a first bypass conduit extending between the first pair of wellbore isolation devices to a fluid within the annulus to axially traverse the first formation zone;

a second bypass conduit extending between the second pair of wellbore isolation devices to receive the fluid downhole from the first bypass conduit and allow the fluid to axially traverse the second formation zone;

one or more injection outlets provided on the first bypass conduit to infect a portion of the fluid traversing the first formation zone into the first subterranean formation and thereby push hydrocarbons toward the second subterranean formation; and one or more influx ports defined in the production tubing at the second formation zone to simultaneously draw in the hydrocarbons pushed toward the second subterranean formation.

2. The well system of claim 1, wherein the wellbore is at least partially lined with casing and cement, the well system further comprising:

one or more first perforations defined through the casing and cement and extending into the first subterranean formation; and one or more second perforations defined through the casing and cement and extending into the second subterranean formation.

3. The well system of claim 1, wherein the first and second pair of wellbore isolation devices are packers and the first and second bypass conduits extend through the first and second pair of wellbore isolation devices, respectively.

4. The well system of claim 1, wherein the first and second subterranean formations are part of the same subterranean formation.

5. The well system of claim 1, wherein the fluid in the annulus is a gas, water, or a combination of gas and water.

6. The well system of claim 1, wherein the fluid in the annulus originates either at a surface location or at an intermediate point within the wellbore between the surface location and the first formation zone.

7. The well system of claim 1, wherein at least one of the first and second bypass conduits is a tubular member extending axially along an exterior of the production tubing.

8. The well system of claim 1, wherein the second bypass conduit is annular and extends about an outer circumference of the production tubing and interposes the production tubing and the second pair of wellbore isolation devices.

9. The well system of claim 8, further comprising one or more production ports defined radially through the second bypass conduit and angularly aligned with the one or more influx ports.

10. The well system of claim 1, wherein at least one of the one or more injection outlets is a nozzle configured to restrict a flow of the fluid into the first subterranean formation.

11. The well system of claim 1, further comprising a sleeve arranged on the production tubing and movable between an open position, where the one or more influx ports are exposed, and a closed position, where the one or more influx ports are occluded.

12. A method, comprising:

introducing production tubing into a wellbore penetrating a first subterranean formation and a second subterranean formation, an annulus being defined between the wellbore and the production tubing;

securing the production tubing within the wellbore with first and second pairs of wellbore isolation devices arranged about the production tubing, the first pair of wellbore isolation devices being located adjacent the first subterranean formation to define a first formation zone within the annulus, and the second pair of wellbore isolation devices being located adjacent the second subterranean formation to define a second formation zone within the annulus;

conveying a fluid within the annulus to the first formation zone;

conveying the fluid through a first bypass conduit extending between the first pair of wellbore isolation devices and thereby axially traversing the first formation zone;

receiving the fluid downhole from the first bypass conduit with a second bypass conduit extending between the second pair of wellbore isolation devices;

injecting a portion of the fluid traversing the first formation zone into the first subterranean formation via one or more injection outlets provided on the first bypass conduit and thereby pushing hydrocarbons toward the second subterranean formation; and simultaneously drawing the hydrocarbons pushed toward the second subterranean formation into the production tubing via one or more influx ports defined in the production tubing at the second formation zone.

13. The method of claim 12, further comprising conveying the fluid across the second formation zone via the second bypass conduit.

14. The method of claim 12, wherein the first and second pairs of wellbore isolation devices are swell packers and securing the production tubing within the wellbore comprises:

expanding the first and second pairs of wellbore isolation devices; and sealing portions of the annulus with the first and second pairs of wellbore isolation devices.

15. The method of claim 12, wherein conveying the fluid within the annulus to the first formation zone comprises introducing the fluid into the annulus at a surface location.

16. The method of claim 12, wherein conveying the fluid within the annulus to the first formation zone comprises introducing the fluid into the annulus at an intermediate point within the wellbore between a surface location and the first formation zone.

17. The method of claim 12, wherein at least one of the one or more injection outlets is a nozzle, the method further comprising restricting a flow of the portion of the fluid into the first subterranean formation with the nozzle.

18. The method of claim 12, further comprising axially moving a sleeve arranged within the production tubing to regulate a flow of the hydrocarbons through the one or more influx ports, the sleeve being movable between an open position, where the one or more influx ports are exposed, and a closed position, where the one or more influx ports are occluded.

19. The method of claim 13, wherein the second bypass conduit is annular and extends about an outer circumference of the production tubing, and wherein drawing the hydrocarbons into the production tubing at the second formation zone further comprises conveying the hydrocarbons through one or more production ports defined radially through the second bypass conduit.

* * * * *